US007065831B2

(12) United States Patent
Elmer

(10) Patent No.: US 7,065,831 B2
(45) Date of Patent: Jun. 27, 2006

(54) SLIDING ELEMENT WITH KEEPER DEVICE SUSPENDED FROM AND GUIDED ON A ROLLER RAIL BY SUPPORT ROLLERS

(75) Inventor: Hubert Elmer, Innsbruck (AT)

(73) Assignee: Dorma GmbH & Co. KG, Ennepetal (DE)

( * ) Notice: Subject to any disclaimer, the term of this patent is extended or adjusted under 35 U.S.C. 154(b) by 68 days.

(21) Appl. No.: 10/498,631

(22) PCT Filed: Mar. 18, 2003

(86) PCT No.: PCT/EP03/02796

§ 371 (c)(1),
(2), (4) Date: Jun. 12, 2004

(87) PCT Pub. No.: WO03/078774

PCT Pub. Date: Sep. 25, 2003

(65) Prior Publication Data

US 2005/0102792 A1 May 19, 2005

(30) Foreign Application Priority Data

Mar. 18, 2002 (DE) ..... 102 12 011

(51) Int. Cl.
*A47H 15/00* (2006.01)
*E05D 15/00* (2006.01)

(52) U.S. Cl. ..... 16/91; 16/106; 49/404; 49/409; 160/196.1

(58) Field of Classification Search ..... 16/91, 16/94 R, 95 R, 96 R, 101–102, 106–107; 160/196.1, 199; 49/409, 404, 425
See application file for complete search history.

(56) References Cited

U.S. PATENT DOCUMENTS

| | | | | | |
|---|---|---|---|---|---|
| 1,983,959 | A | * | 12/1934 | Wuebling | 16/91 |
| 2,026,955 | A | * | 1/1936 | Weigele | 16/91 |
| 2,659,939 | A | * | 11/1953 | Greig | 49/425 |
| 3,950,952 | A | * | 4/1976 | Krings | 405/282 |
| 4,035,956 | A | * | 7/1977 | Newson | 49/280 |
| 4,099,599 | A | * | 7/1978 | Randall | 187/313 |
| 4,177,881 | A | * | 12/1979 | Kappenhagen | 187/324 |
| 4,651,469 | A | * | 3/1987 | Ngian et al. | 49/223 |
| 4,873,741 | A | * | 10/1989 | Riegelman | 16/105 |
| 4,905,345 | A | | 3/1990 | Lunenschloss et al. | |
| 5,247,763 | A | * | 9/1993 | Hein | 49/31 |
| 5,494,137 | A | | 2/1996 | Kowalczyk et al. | |
| 5,678,280 | A | * | 10/1997 | Haab et al. | 16/87.6 R |

FOREIGN PATENT DOCUMENTS

| | | | | |
|---|---|---|---|---|
| DE | 2408470 | A | * | 8/1975 |
| DE | 197 46 776 | | | 5/1998 |
| DE | 20012203 | U1 | * | 10/2000 |
| EP | 45139 | A | * | 2/1982 |
| FR | 2362987 | A | * | 4/1978 |
| GB | 659625 | | | 10/1951 |

* cited by examiner

*Primary Examiner*—Chuck Y. Mah
(74) *Attorney, Agent, or Firm*—Cohen, Pontani, Lieberman & Pavane

(57) ABSTRACT

The invention relates to a sliding element, which is suspended and guided on a running track by means of roller carriers or gliding elements, using running track retainers that are connected to a substructure and engage with the underside of the running track. The invention also relates to an anti-removal device, which comprises a locking elements that can be pressed elastically against the running track and that yields when crossed by a running track retainer.

6 Claims, 5 Drawing Sheets

SLIDING ELEMENT WITH KEEPER DEVICE SUSPENDED FROM AND GUIDED ON A ROLLER RAIL BY SUPPORT ROLLERS

PRIORITY CLAIM

This is a U.S. national stage of application No. PCT/EP03/02796, filed on 18 Mar. 2003. Priority under 35 U.S.C. §119(a) and 35 U.S.C. §365(b) is claimed from German Application No. 102 12 011.0, filed 18 Mar. 26, 2002.

BACKGROUND OF THE INVENTION

1. Field of the Invention

The invention pertains to a sliding element suspended from and guided on the top of a roller rail by support rollers or glide elements, where the roller rail is connected to a substructure by roller rail brackets, which grip the roller rail from underneath, and where a keeper device located underneath the roller rail is attached to the sliding element or to components attached to the sliding element.

2. Description of the Related Art

In the usual case, a gap is present between the sliding element and the bottom of the roller rail; this gap is intended to make it possible to hang the sliding element, including its support rollers, as a single unit from the roller rail. During normal use of the sliding element, this gap can allow the sliding element to jump unintentionally off the rail. To prevent this, keeper devices are provided on the sliding elements or on parts attached to them. The outer contour of the keeper device which faces the roller rail is only a short distance away from the outer periphery of the roller rail, which means that the sliding element cannot be disengaged from the rail until after the keeper devices have been removed. If, however, the roller rail brackets that support the roller rail are of the type which grip the rail from underneath, difficulties can occur when keeper devices of this type travel over them.

U.S. Pat. No. 4,905,345 discloses a sliding element which is suspended from and guided on a guide rail by straps extending between the sliding element and the support rollers. The guide rail is supported in a U-shaped support profile, which is open at the top, and, like the support profile, is made up of several subsections. The subsections of the support profile are supported, at the points where they butt up against each other, by angle-shaped brackets, the horizontal shanks of which grip the support profile from underneath. No measures are taken to prevent the sliding element from jumping off the rail unintentionally.

In known sliding elements suspended by straps, keeper devices are provided, which are rigidly connected to the straps. Part of the outer contour of each keeper device wraps around or extends under the outer contour of the roller rail with a certain amount of play. This play is necessary to allow the keeper device to travel over the roller rail bracket, but it must also allow the device to fulfill its "keeping" function at the same time

SUMMARY OF THE INVENTION

The task of the invention is to provide a keeper device which extends under the roller rail and under the roller rail bracket with very little play—possibly without any play at all—but also in such a way that the sliding element is prevented from jumping off the rail as it travels along the rail and as it travels over a bracket.

According the invention, the keeper device has a locking element, which can rest elastically against the roller rail but which can also give way when it travels over a roller rail bracket. The solution according to the invention ensures that the locking element always rests against the roller rail or travels over the rail with such a small amount of play that it is impossible for the sliding element to jump off the rail. At the same time, because the locking element rests elastically against the roller rail, the locking element can give way as it travels over the roller rail bracket while still fulfilling its keeping function.

According to an especially advantageous embodiment of the invention, the keeper device has a locking element, which:

projects from the bracket of the keeper device toward the roller rail;

rests elastically against the roller rail; and prevents the sliding element from jumping out of position, and which, when it travels over a roller rail bracket, is pushed down into the bracket of the keeper device against the elastic force, thus releasing the locking action of the locking element. According to the above features, the locking element, which is supported, for example, in a pocket-like receptacle in the bracket of the keeper device, is supported in the bracket in such a way that the locking element is prevented from being pushed down into the bracket as long as the locking element is sliding along the roller rail, so that the keeping function remains ensured. When it travels over one of the roller rail brackets extending under the roller rail, however, the locking element is pushed far enough down into the bracket of the keeper device against the force of a spring that the keeper device can pass underneath the part of the roller rail bracket which extends under the roller rail without any loss of the keeping function. The keeper device can be in continuous contact with the roller rail and the roller rail brackets.

The locking element is advantageously supported in a pocket in the bracket of the keeper device so that it extends at a right angle to the travel direction of the sliding element and can also pivot around an axis extending in the travel direction of the sliding element, where the pivoting path of the locking element is limited in both directions by contact surfaces on the locking element.

The pivoting path of the locking element, as it travels over the roller rail in the position in which it prevents the sliding element from jumping out of position, is limited by a locking lobe on the locking element, which is located on the side of the roller rail facing the substructure, outside the longitudinal center axis of the roller rail and adjacent to the outer periphery of the roller rail. The pivoting path of the locking element in the opposite direction which occurs when the keeper device travels over a roller rail bracket, however, is limited by the contact of the locking lobe of the locking element with the roller rail bracket, it being ensured that the pivoting path still has a sufficient amount of play.

By means of the measures indicated above, a keeper device for a sliding element of the general type described above is created which has an elastically displaceable locking element, which is prevented from being pushed down into the bracket of the keeper device as long as the device is traveling over the roller rail, but which can be pushed down when it travels over a roller rail bracket.

The locking element is elastically supported in the bracket of the keeper device preferably by providing bores in both the bracket of the keeper device and the locking element, these bores being aligned with each other so that the locking element can be rotatably supported on a pin passing through the bores.

So that the locking element can travel over the roller rail bracket without jerking and without causing noise, lead-in bevels are provided on the surface of the locking element facing the roller rail and/or the roller rail bracket. These bevels also initiate simultaneously the pivoting movement of the locking element with respect to the bracket.

The method used to attach the keeper device to the strap carrying the sliding element is basically arbitrary; an advantageous way of doing this, however, is to provide the device with a pin, which can be plugged into the strap. It would also be possible to use a dovetail joint, etc.

DETAILED DESCRIPTION OF THE PRESENTLY PREFERRED EMBODIMENTS

Figure 1:
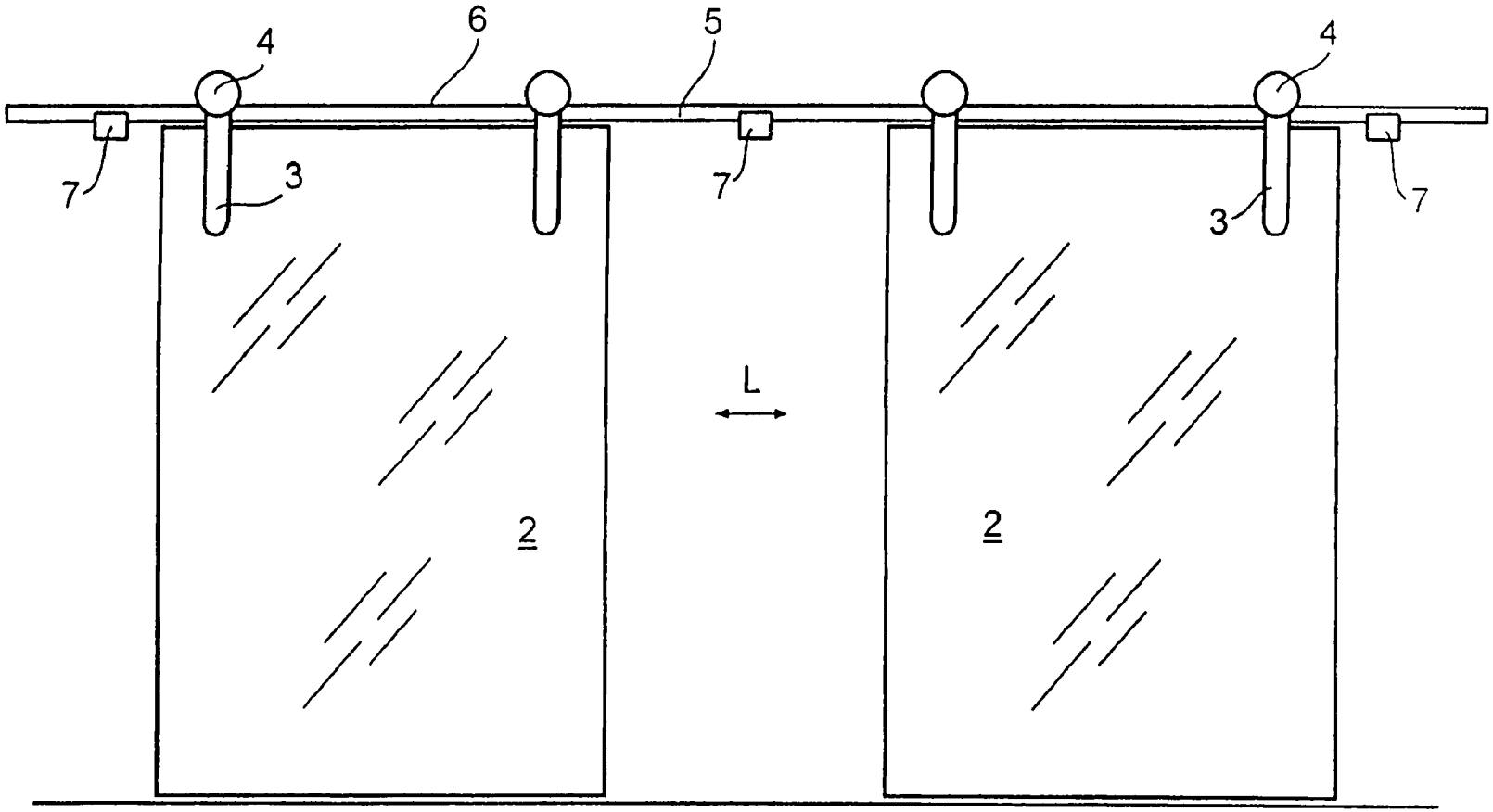
FIG. 1 shows a partial schematic diagram of a glass wall.

FIG. 1 shows a glass wall 1, which, in this exemplary embodiment, consists of two sliding elements 2, guided on a roller rail 5. The sliding elements can be moved back and forth in the direction of the arrow L. The sliding elements 2 are suspended from and guided on the top 6 of the roller rail 5 by straps 3 and support rollers 4. The roller rail 5 is attached by roller rail brackets 7 to a substructure (10) (See FIGS. 2 and 3).

Figure 2:
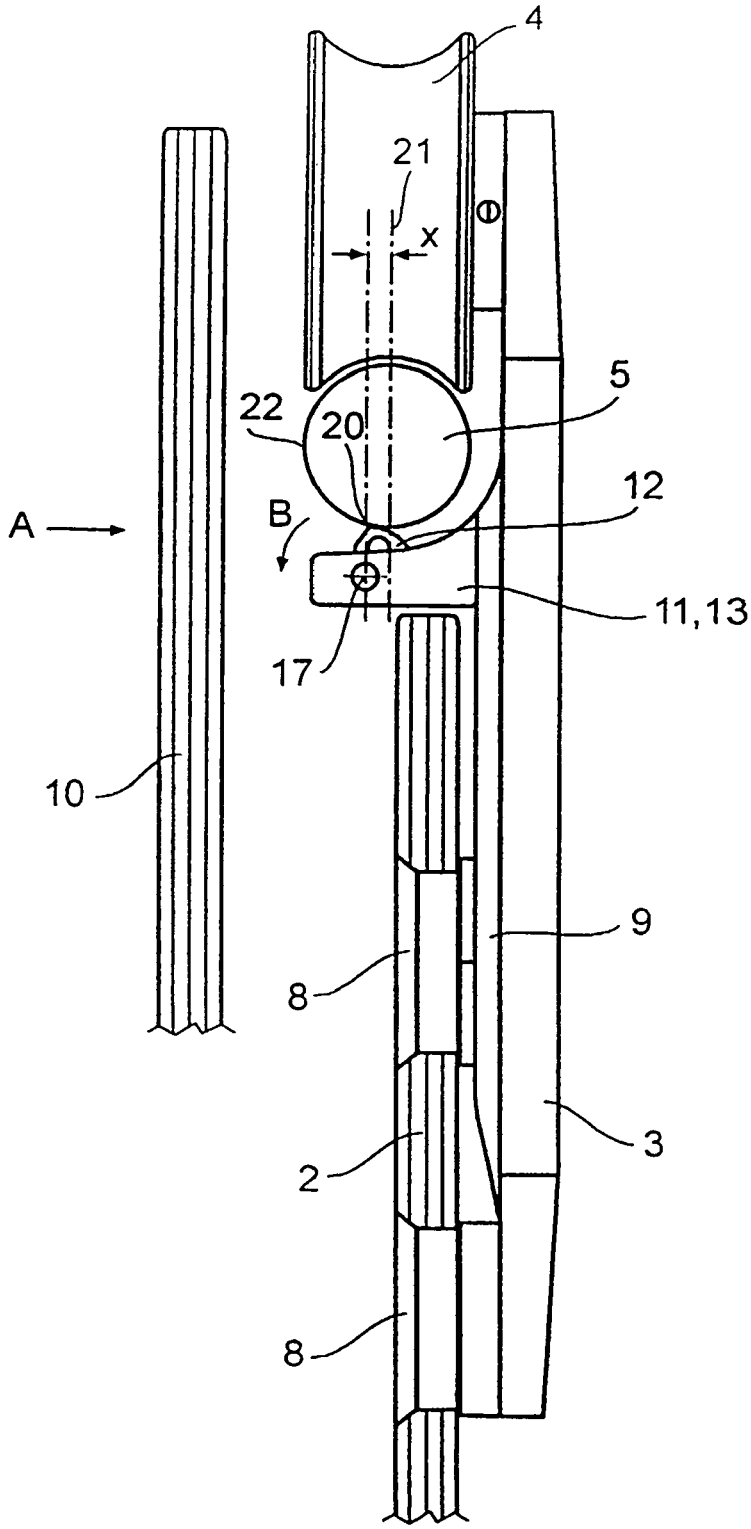
FIG. 2 shows an enlarged diagram of a vertical cross section through the glass wall of FIG. 1 as the wall travels along the roller rail.
Figure 3:
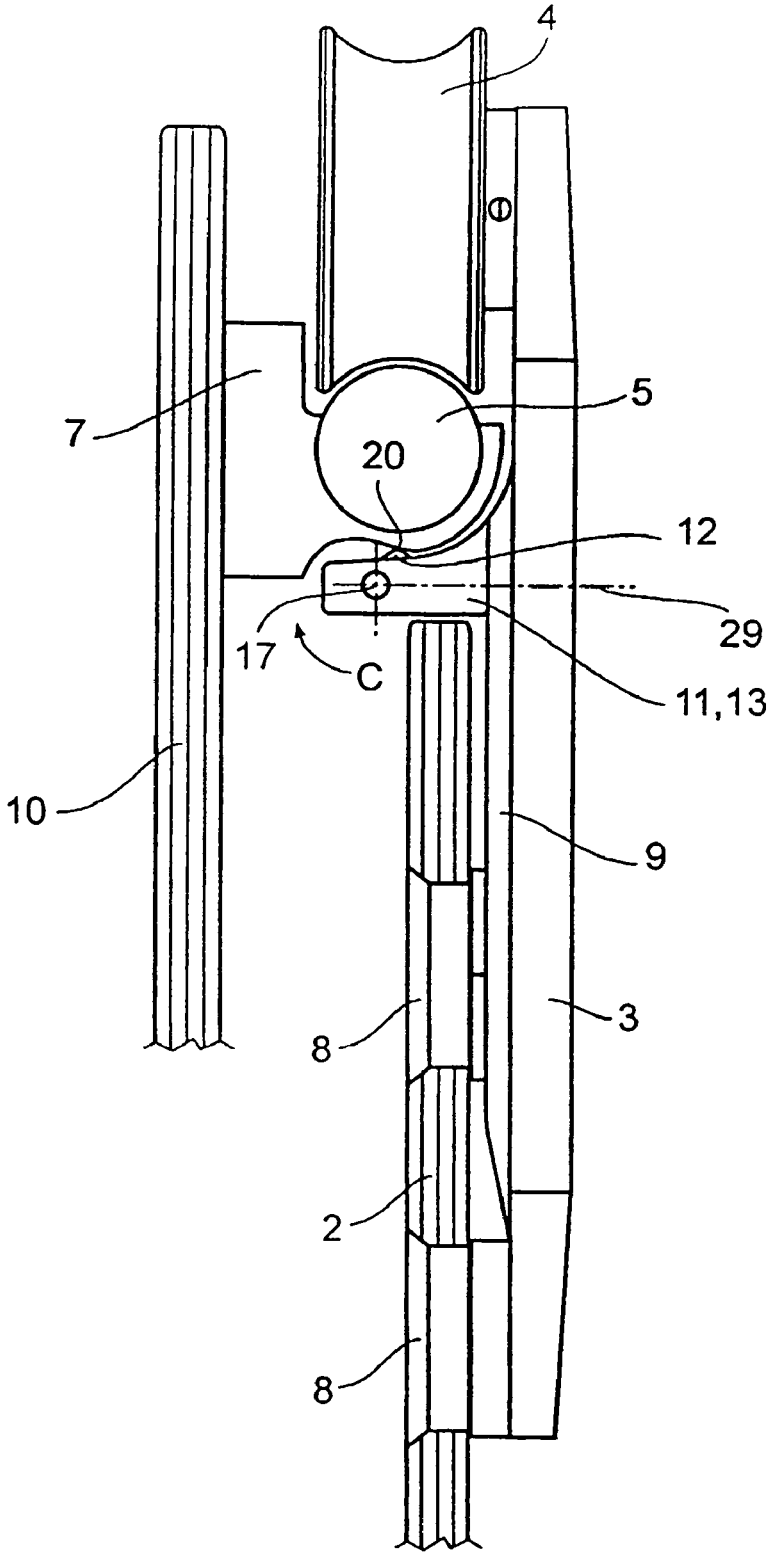
FIG. 3 shows a view similar to FIG. 2, except that here the wall is traveling over a roller rail bracket.
Figure 4:
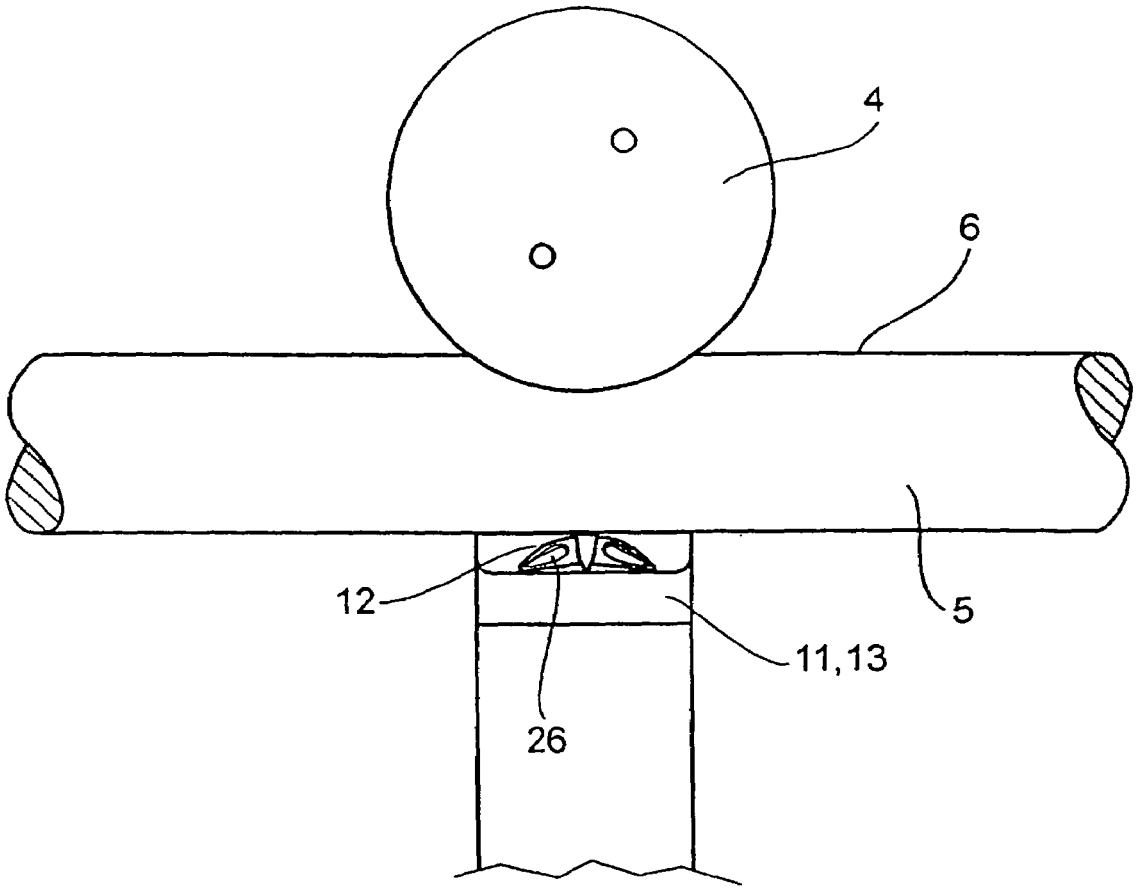
FIG. 4 shows a partial side view of the same area as that in FIG. 2 except that the substructure has been omitted.

As can be seen in FIGS. 2 and 3, the straps 3 are connected by point retainers 8 to the sliding element. In the exemplary embodiment, a cover 9, resting on the strap 3, is provided between the strap 3 and the sliding element 2. A keeper device 11 is connected to the strap 3, i.e., to the cover 9, by a screw connection 29. The device has a part called a bracket 13, the top of which (not shown) is hollow like a box, so that a locking element 12 can be supported in this box-like opening. The locking element 12 is pretensioned in the direction of the arrow B by a spring 5, shown in FIG. 5, and when the element is traveling over the roller rail 5, it assumes the position illustrated in FIG. 2. The locking lobe 20 of the locking element 12 adjacent to or resting against the outer periphery 22 of the roller rail 5 is located a certain distance, designated "x", away from the center longitudinal axis 21 of the roller rail 5 and prevents the sliding element 2 from jumping off the rail. The path around which the locking element 12 can pivot in this one direction, designated by the arrow B, has reached a limit in this position. The locking element 12 thus cannot pivot any further around its axis 17.

When the locking element 12 travels over the roller rail bracket 7, as shown in FIG. 3, it gives way by pivoting around its axis 17 in the direction of the arrow C in a manner to be explained below. As a result, it can pass underneath the part of the roller rail bracket 7 which extends under the roller rail 5; the locking lobe 20 now rests against the part of the roller rail bracket 7 which supports the rail from underneath. The pivoting path in the direction of the arrow C is calculated so that the locking element 12 can be pushed down into the pocket (not shown) in the bracket 13 sufficiently to allow the keeper to pass under the rail bracket.

FIGS. 4–7 show how lead-in bevels 26 are provided on the surface 25 of the locking element 12 facing the roller rail 5 and the roller rail bracket 7; these bevels make it easier for the locking element 12 to pivot from the position shown in FIG. 2 to the position shown in FIG. 3 and also make it possible for the element to travel over the roller rail bracket 7 without jerking.

Figure 5:
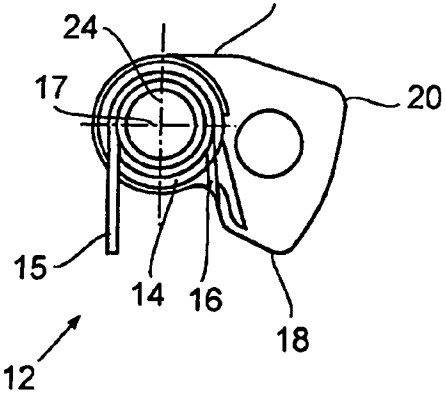
FIG. 5 shows a side view of the locking element.

The side view of the locking element 12 according to FIG. 5 shows the arrangement of a spring 14, the shank 15 of which is supported on the bottom of the pocket (not shown) of the bracket 13, whereas the shank 16 is supported on the locking element. The continuous bore 24 in the locking element 12 aligns with corresponding bores 23 in the bracket 13, so that a pin (not shown) can be inserted through the bores 23 and 24. FIG. 5 also shows that the locking element 12 has contact surfaces 18, 19. The contact surface 19 works together with a contact surface (not shown) on the pocket (not shown) in the bracket 13 to limit the distance over which the element can travel when it is assuming the position shown in FIG. 2, whereas the contact surface 18 limits the distance over which the element can pivot when it is assuming the position shown in FIG. 3.

Figure 6:
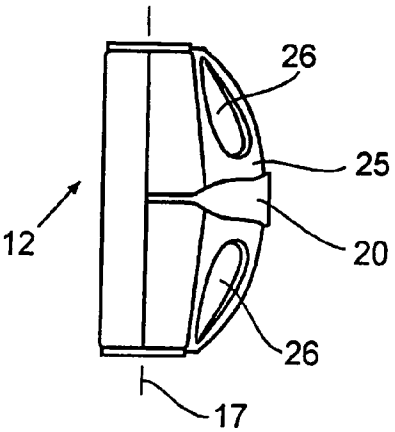
FIG. 6 shows a view of the locking element from the perspective of the substructure.
Figure 7:
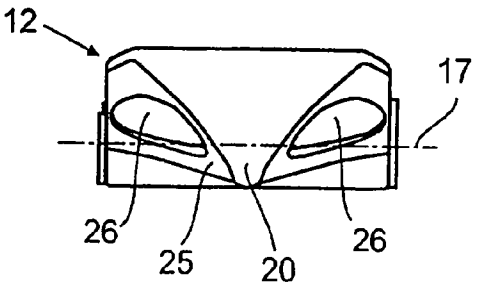
FIG. 7 shows a top view of the locking element of FIG. 6.

The diagram in FIG. 6 shows the locking element from the perspective of the substructure (in the direction of the arrow A); the diagram in FIG. 7 shows a top view of the locking element shown in FIG. 6.

Figure 8:
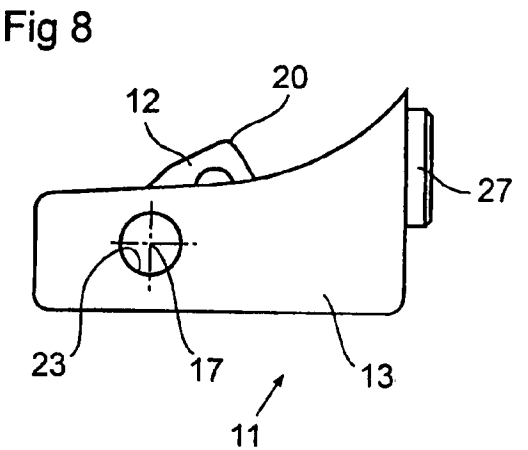
FIGS. 8 and 9 show two ways in which the keeper device can be attached to a strap.
Figure 9:
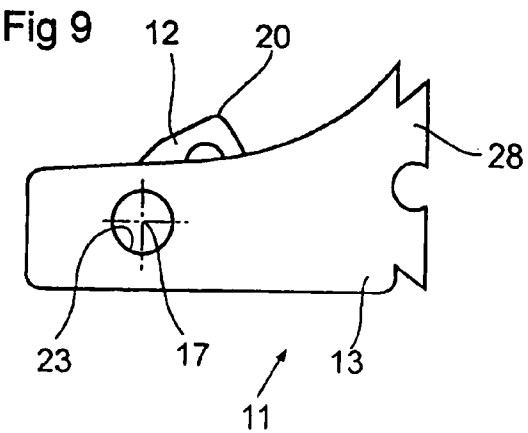

In the exemplary embodiment according to FIG. 8, the bracket 13 of the keeper device 11 has a pin 27, which can be inserted into an appropriate opening in the strap 3. In the exemplary embodiment according to FIG. 9, the bracket is attached to the strap by means of a dovetail joint 28.

What is claimed is:

1. A sliding element suspended from and guided on top of a roller rail mounted on roller rail brackets which grip the roller rail underneath, the roller rail brackets being fixed to a substructure, the sliding element comprising:

a suspended element;

a plurality of support rollers or glide elements attached to the suspended element and guided on top of the roller rail in a direction of travel; and a keeper device attached to the suspended element and located underneath the roller rail, the keeper device comprising a keeper bracket and a locking element, wherein the keeper bracket has a pocket in which the locking element is mounted to pivot about a pivot axis parallel to the direction of travel, the locking element projects from the keeper bracket and is spring-loaded, in a locking direction, against the roller rail to provide a locking action which prevents the support rollers or glide elements from jumping off the roller rail, the locking element is pushed, in a release direction opposite to the locking direction, into the keeper bracket to release the locking action when the keeper device travels over a roller rail bracket, the locking element has contact surfaces which limit the pivoting of the locking element in the locking direction and the release direction, respectively, and wherein the roller rail has a central longitudinal axis, the locking element having a locking lobe which engages the roller rail toward the substructure from the central longitudinal axis.

2. The sliding element of claim 1, wherein the locking lobe engages the roller rail bracket to limit the pivoting of the locking element in the release direction when the keeper device travels over the roller rail bracket, with a small amount of play in the release direction remaining.

3. The sliding element of claim 1, wherein the keeper bracket and the locking element have coaxial bores.

4. The sliding element of claim 1, wherein the locking element has a surface facing the roller rail, the surface having lead-in bevels facing the direction of travel, the lead-in bevels causing the locking element to retreat when the keeper device reaches the roller rail bracket.

5. The sliding element of claim 1, further comprising a strap fixed to the suspended element, the keeper device being attached to the strap.

6. The sliding element of claim 5, wherein a support roller is attached to the strap above the keeper device.

* * * * *